US005988688A

United States Patent [19]

Such

[11] Patent Number: 5,988,688

[45] Date of Patent: Nov. 23, 1999

[54] BONDED LOTTERY STAMP TICKET BOOK

[75] Inventor: David A. Such, Great Falls, Mont.

[73] Assignee: World Wide Press, Inc., Great Falls, Mont.

[21] Appl. No.: 08/803,138

[22] Filed: Feb. 19, 1997

[51] Int. Cl.[6] ..... B42D 1/00; B42D 15/00; B32B 7/14

[52] U.S. Cl. ..... 283/100; 283/903; 273/139; 273/269; 273/270

[58] Field of Search ..... 283/903, 100; 273/139, 269, 270

[56] References Cited

U.S. PATENT DOCUMENTS

| | | | |
|---|---|---|---|
| 1,835,909 | 12/1931 | Shoemaker, Jr. | 462/11 |
| 3,930,673 | 1/1976 | Sanden | 283/6 |
| 3,940,124 | 2/1976 | Johnsen | 270/61 F |
| 3,956,049 | 5/1976 | Johnsen | 156/200 |
| 4,099,721 | 7/1978 | Logander | 273/139 |
| 4,270,774 | 6/1981 | Barnes | 283/62 |
| 4,398,708 | 8/1983 | Goldman et al. | 270/18 |
| 4,842,303 | 6/1989 | Molenda | 281/2 |
| 5,106,090 | 4/1992 | Greenwood | 283/903 |
| 5,125,689 | 6/1992 | Heninger | 283/106 |
| 5,253,899 | 10/1993 | Greenwood | 283/106 |
| 5,641,550 | 6/1997 | Berman et al. | 281/2 |

FOREIGN PATENT DOCUMENTS

| | | | |
|---|---|---|---|
| 1105041 | 3/1968 | United Kingdom | 283/903 |

*Primary Examiner*—Willmon Fridie, Jr.
*Assistant Examiner*—Mark T. Henderson
*Attorney, Agent, or Firm*—Webb Ziesenheim Logsdon Orkin & Hanson, P.C.

[57] ABSTRACT

A bonded lottery stamp ticket book having a plurality of stiff tickets secured to each other, each ticket having a first layer, the first layer having an upper surface and a binding region, the upper surface having indicia, the indicia being numbers, letters, symbols, figures or combinations thereof. Each ticket also has a second layer wherein the second layer has a border, a tab and a lower surface. The lower surface of the second layer is attached to the upper surface of the first layer at the border. The tab is frangibly attached to the border covering the indicia so that opening the tab reveals the indicia. The tickets are stacked upon and bonded to each other at the binding region to form the ticket book. The tickets are sufficiently flexible so that each ticket may be bent away from adjacent tickets.

9 Claims, 5 Drawing Sheets

BONDED LOTTERY STAMP TICKET BOOK

BACKGROUND OF THE INVENTION

1. Field of the Invention

The invention is directed to bonded lottery stamp tickets having the appearance of a book and a method for preparing such a bonded lottery stamp ticket book where the bonded lottery stamp ticket book has at least two or more tickets stacked upon and bonded to each other, and each ticket has a peel-away tab. Peeling away the tab will expose symbols, numbers or other indicia. Each ticket in the book of bonded lottery stamp tickets has sufficient flexibility so that it may be bent away from adjacent tickets in the ticket book and the tab of each underlying ticket may be bent back to reveal the symbols, numbers or other indicia without separating the tickets.

2. Description of the Prior Art

A number of patents have issued disclosing a variety of articles of multi-ply construction having an interior exposable indicia. However, the previous embodiments do not disclose a plurality of multi-layered tickets stacked one upon another and bonded in the form of a ticket book with the features herein described.

U.S. Pat. Nos. 4,398,708 to Goldman et al., 4,270,774 to Barnes and 3,956,049 and 3,940,124 to Johnsen disclose singular multi-ply lottery tickets joined to each other end-to-end to form a sheet of lottery tickets. The lottery tickets may be then either separated or stored in an accordion-like manner. None of these patents discloses dispensing the lottery tickets in a book form wherein each ticket is flexible and is stacked upon the next ticket front-to-back.

U.S. Pat. Nos. 3,930,673 to Sanden, 4,099,721 to Logander, 5,125,689 to Heninger and 5,253,899 to Greenwood disclose single lottery tickets having multiple sections folded upon each other. The folding and printing of the indicia in each case allow a person opening the ticket to reveal indicia in a unique manner.

The prior art, as disclosed by these patents, discloses multi-layered tickets, folded tickets and groupings of these tickets formed on a single sheet and folded in an accordion-like manner. None of these prior art patents describes books of multi-layered tickets, each ticket being flexible so that it may be bent away from adjacent tickets and the tab of each identifying ticket may be bent back to reveal underlying symbols, numbers or other indicia without separating the tickets.

SUMMARY OF THE INVENTION

The present invention is directed to bonded lottery stamp tickets having the appearance of a book and a method for preparing such a book. The bonded lottery stamp ticket book is constructed of two or more, say up to eight, tickets. Each ticket is formed in two layers and has sufficient stiffness so that it will not curl or droop under its own weight. The first layer has an upper surface having symbols, numbers or other indicia. The second layer has a border and a tab attached frangibly to the border. The border of the second layer is attached to the upper surface of the first layer. The tab is oriented over the symbols, numbers or other indicia so that the tab may be broken away to reveal the underlying symbols, numbers or others indicia. Each ticket in the plurality of tickets used to form the ticket book has a binding region. The tickets are stacked onto each other front-to-back and the tickets are fastened to each other at the binding region.

The tickets have sufficient flexibility so that each ticket may be bent away from adjacent tickets so that the tab of the underlying ticket may be removed to reveal the symbols, numbers or other indicia. Flexibility of the ticket is conferred upon the ticket via the structure of the ticket which involves the combination of materials used to produce the ticket and the physical dimensions of the ticket. Alternatively, flexibility may be conferred upon the ticket by engineering a crease between the binding region and the indicia of each ticket to create a hinge upon which the ticket may be folded back. On the other hand, the individual tickets must have sufficient stiffness to avoid curling apart until manually bent to expose the tab.

Lottery tickets are commonly provided in the form of single tickets or groups of tickets attached to one another in accordion-like fashion. Such tickets are dispensed either manually or mechanically by dispensation off of a continuous roll or a strip which is folded in an accordion-like manner. The bonded lottery stamp ticket book according to this invention offers an alternative to the traditional roll or strip form of tickets that can be easily dispensed either automatically or manually.

The bonded lottery stamp ticket book according to this invention also offers an alternative method of playing lottery ticket games. Many lottery ticket games include a plurality of indicia on the same ticket. The prior art lottery game may be played by revealing one or more of the hidden indicia on the same ticket. The present invention provides a new manner for playing such lottery games wherein one or more symbols, numbers or other indicia on each ticket of a lottery book may be revealed to indicate whether the player has uncovered a desired symbol, number or other indicia or combination thereof.

Other objects and features of the invention will be readily apparent from the following detailed description.

BRIEF DESCRIPTION

Further features and other objects and advantages will become clear from the following detailed description made with reference to the drawings in which.

DETAILED DESCRIPTION OF THE PREFERRED EMBODIMENTS

The bonded lottery stamp ticket book of the present invention defines a plurality of flexible multi-layer lottery tickets, each ticket having a tab which will reveal symbols, numbers or other indicia upon removal. The tickets are stacked and bonded to each other to form a book or booklet of lottery stamp tickets.

Figure 1:
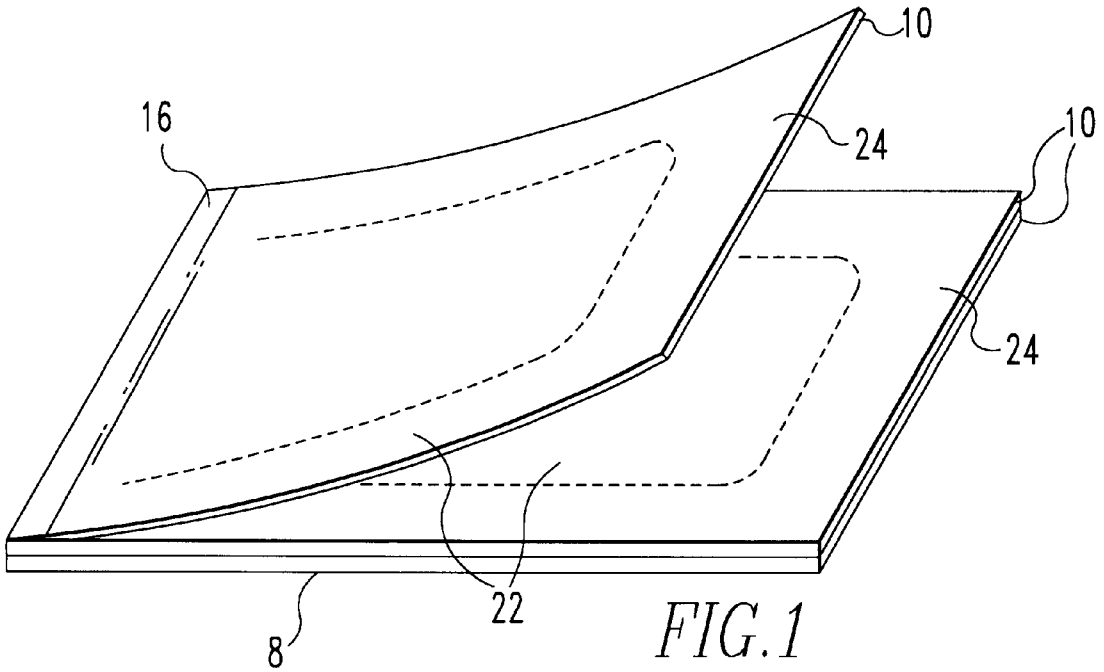
FIG. 1 shows a bonded lottery stamp ticket book wherein a ticket is flexed away from adjacent tickets in the book.
Figure 2:
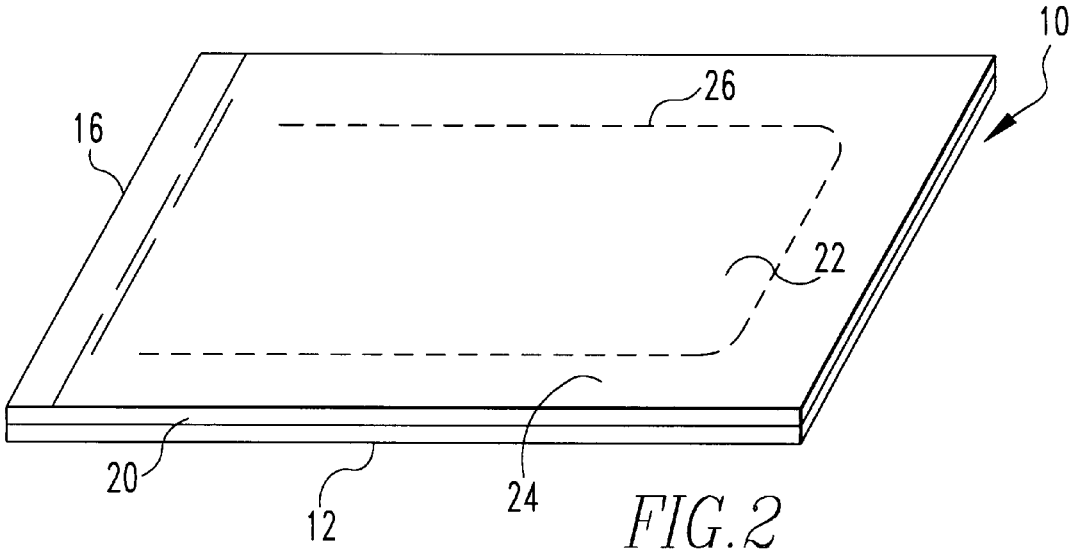
FIG. 2 shows a single ticket having a bend-away tab, showing the tab in a closed position.

As shown in FIG. 1, a bonded lottery stamp ticket book 8 is shown having a plurality of tickets 10. The tickets 10 have sufficient flexibility so that each ticket 10 may be bent away from adjacent tickets 10 in the bonded lottery stamp ticket book 8. The tickets 10 are shown stacked upon each other, bonded at a binding region 16. As shown in FIG. 2, each ticket 10 has a first layer 12 and a second layer 20.

Figure 3:
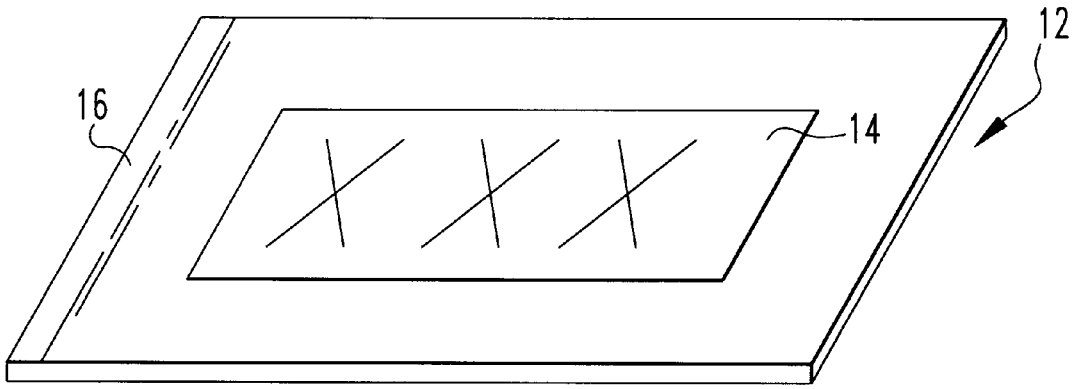
FIG. 3 shows a first layer of a ticket.
Figure 4:
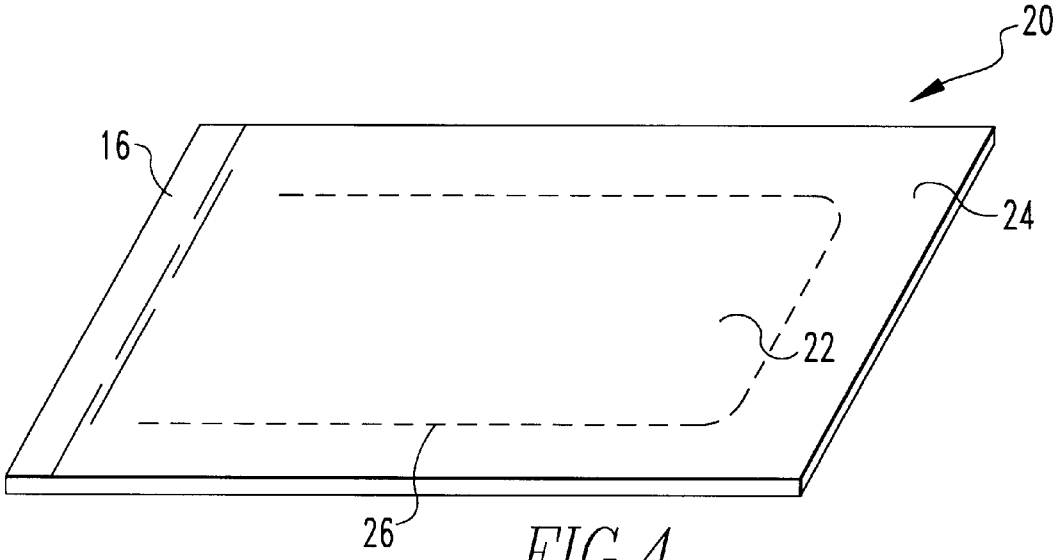
FIG. 4 shows a second layer of a ticket.

As shown in FIG. 3, the first layer 12 has indicia 14 located on the upper side of the first layer 12. The first layer 12 also has a binding region 16. FIG. 4 depicts the second layer 20 of the ticket 10. The second layer 20 has a border 24 frangibly attached to a tab 22, the second layer 20 having, optionally, a binding region 16. The tab 22 may be frangibly attached to the border 24 by any means known to those skilled in the art. Preferably, the tab 22 is frangibly attached to the border 24 by perforations 26, as shown.

The ticket 10 shown in FIG. 2 and the second layer 20 shown in FIG. 4 show perforations 26 frangibly attaching the tab 22 to the border 24. The perforations 26 or other means for frangibly attaching the tab 22 to the border 24 do not completely surround the tab 22 so that when the frangible attachments or perforations 26 are broken, the tab 22 remains attached to the ticket 10 and may be bent back to reveal the underlying indicia 14. The indicia 14 can be numbers, letters, symbols, figures or combinations thereof.

In an assembled ticket 10, the second layer 20 is attached to the first layer 12 by an adhesive or by other means, for instance, the border 24 may be attached to the first layer 12 using an adhesive, staples, crimping, heat sealing, or by treating the edge of the first layer 12 and the second layer 20 with a suitable adhesive or binder. The second layer 20 is attached to the first layer 12 at the border 24. The tab 22 is not attached to the first layer, allowing the tab to be opened as shown in FIG. 5, discussed in detail below.

The first layer 12 and the second layer 20 may be composed of paper, cardboard, plastic, metal foil, combinations thereof or any other suitable sheet material. The indicia 14 may be a number, a letter, a design or combinations thereof and may be printed directly on the lower layer or attached thereto. It will also be appreciated that other indicia may be printed on the outer surface of the ticket 10 as desired.

Figure 5:
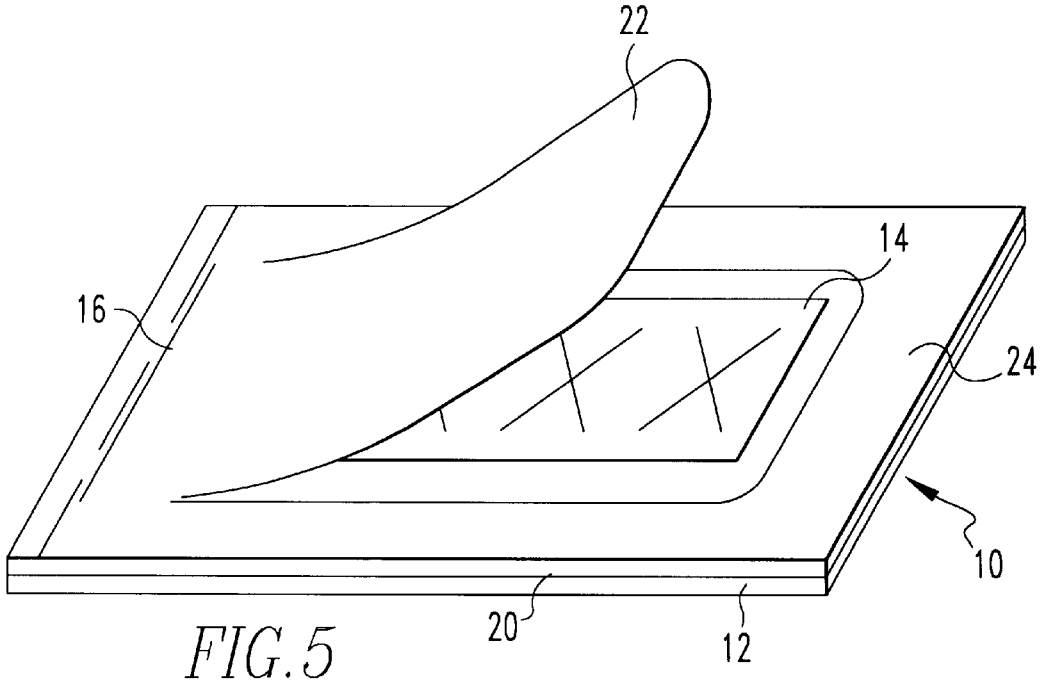
FIG. 5 shows a single ticket having a bend-away tab, the tab is in an open position revealing the underlying indicia.

FIG. 5 depicts a ticket 10 wherein the frangible attachment of the tab 22 to the border 24 has been broken and the tab 22 opened to reveal the underlying indicia 14.

Figure 6:
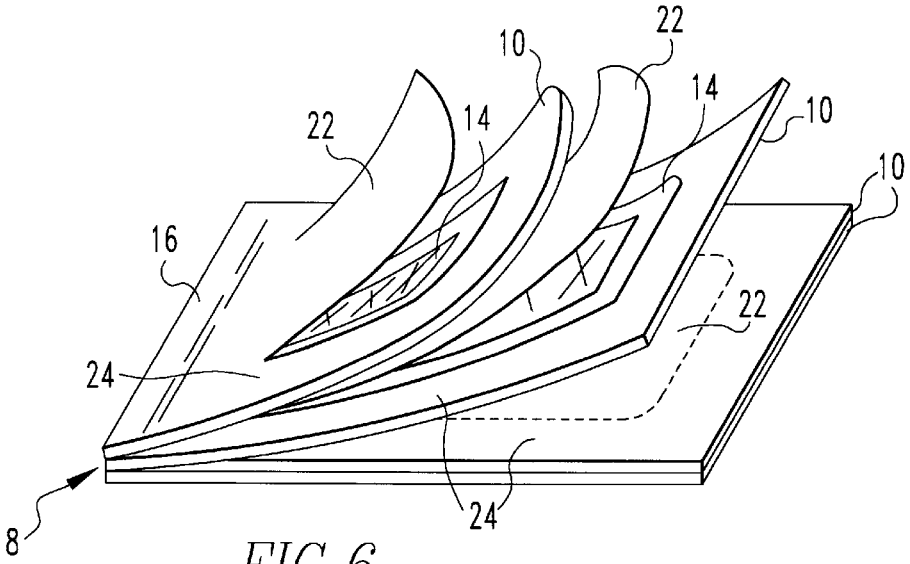
FIG. 6 shows a book of bonded lottery stamp tickets substantially as shown in FIGS. 2 and 5, the tabs are shown in both open and closed positions.

FIG. 6 shows a second embodiment of a bonded lottery stamp ticket book 8 having a plurality of tickets 10 stacked upon and bonded to each other at the binding region 16. In FIG. 6, the tabs 22 of the top two tickets 10 of the bonded lottery stamp ticket book 8 have been opened to reveal the underlying indicia 14. The tabs 22 of the remaining bottom tickets 10 have not been opened.

Figure 7:
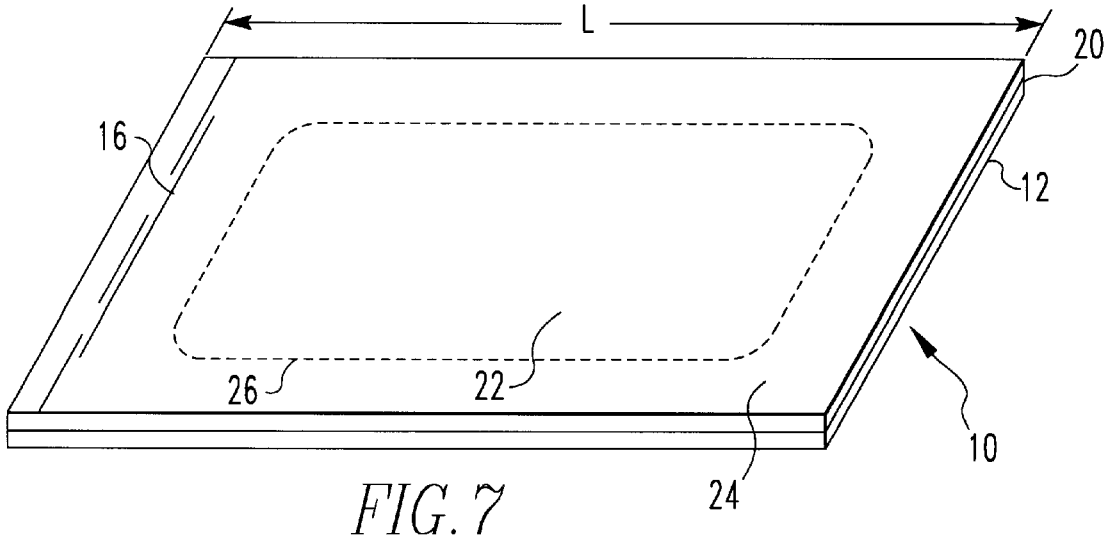
FIGS. 7 and 8 show a single ticket having a removable tab, FIG. 7 showing the tab in a closed position, FIG. 8 showing the tab in an open position, revealing indicia.
Figure 8:
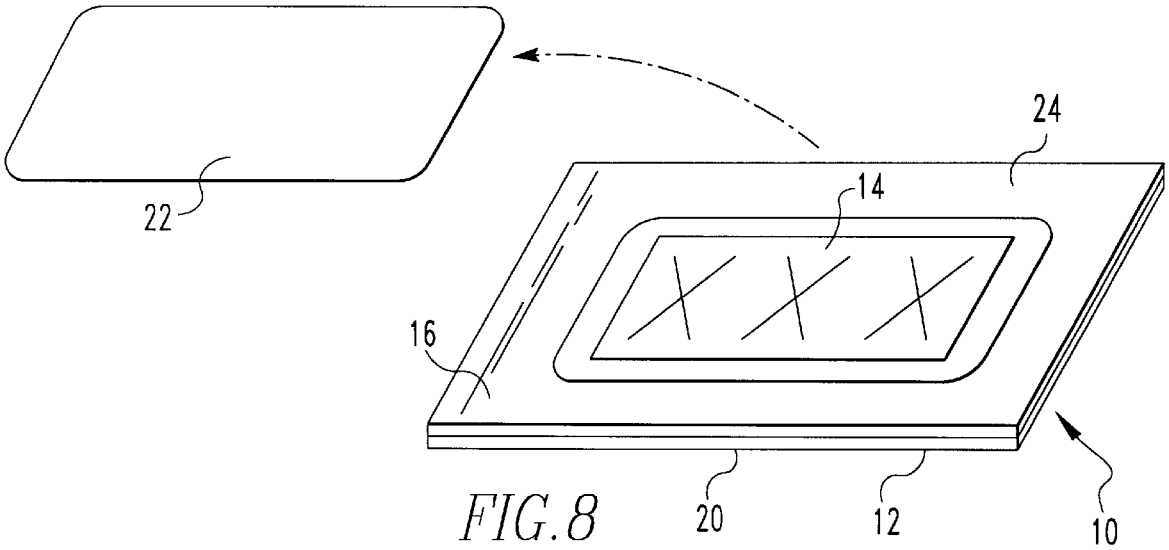

FIGS. 7 and 8 show a second embodiment of the present invention. FIG. 7 shows a ticket 10 having a tab 22 that is frangibly attached to the border 24, preferably by perforations 26 depicted in the Figure. The perforations 26 cover all sides of the tab 22 so that when the tab 22 is removed, as shown in FIG. 8, the tab is completely separated from the ticket 10. This is in contrast to the ticket shown in FIG. 2 wherein the perforations or other means of frangibly attaching the tab 22 to the ticket 10 do not completely surround the tab 22 so that when the frangible attachments or perforations 26 are broken, the tab 22 remains attached to the ticket 10 and may be bent back as opposed to the complete removal of the tab as shown in FIG. 8.

The bonded lottery stamp ticket book 8 may be of varying dimensions, depending upon the number of tickets in the bonded lottery stamp ticket book 8, the thickness of each ticket 10, and the length and width of each ticket 10. On assembly of the bonded lottery stamp ticket book 8, each ticket 10 is stacked upon another, front to back, and the tickets 10 are bonded at their binding region 16. Alternate methods may be used to bind the tickets 10 to one another at the binding region 16, thus defining the nature and location of the binding region. In a first binding method, the binding region may include sufficient surface area of each of the tickets 10 so that a staple may be used to fasten the tickets 10 to one another. In a second binding method, the tickets 10 may be bonded by an adhesive painted on one side of a stack of tickets 10. In such a method, the binding region 16 may comprise a side of each ticket 10 rather than the upper or lower surface of the ticket 10. Other binding means known to those skilled in the art may be employed, therefore differentially defined depending upon the chosen binding means.

Flexibility and stiffness of the tickets 10 may also be achieved by various means. A first means for achieving an acceptable degree of flexibility and stiffness of the tickets 10 so that each ticket 10 may be bent away from adjacent tickets 10 in the bonded lottery stamp ticket book 8 is by constructing the tickets 10 from a material having a given degree of flexibility, such as paper, cardboard, paper board or foil and ensuring that the ratio of the thickness of the ticket 10 to the length of the ticket 10, as depicted by the L in FIG. 7, is sufficiently large to ensure the flexibility of the ticket 10. Generally, a ratio of length of the ticket 10 to thickness of the ticket 10 of 50:1 will confer sufficient flexibility to the ticket 10 so that it may be bent back away from adjacent tickets 10 in the bonded lottery stamp ticket book 8. The tickets may be 0.006 to 0.044 inch thick. In a preferred embodiment, the tickets are 0.015 to 0.044 inch thick.

Figure 9:
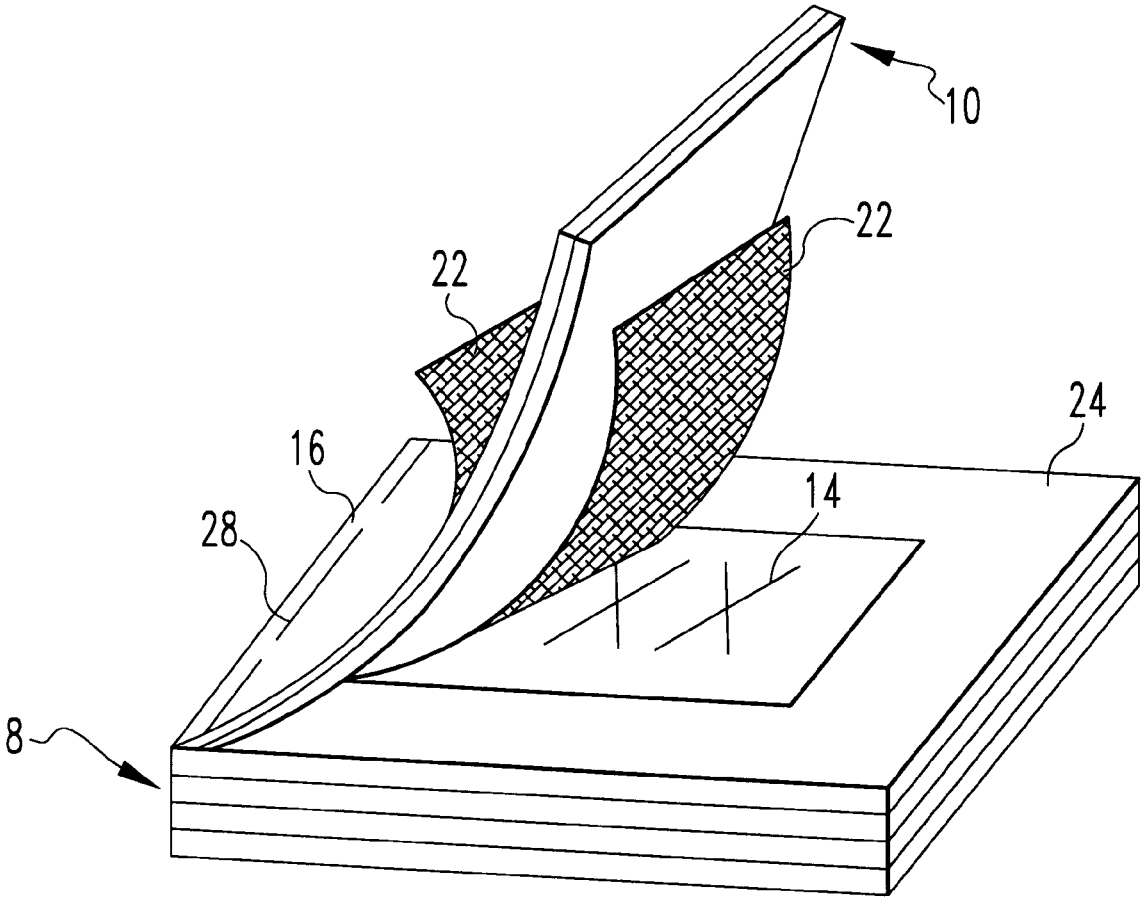
FIG. 9 shows a bonded lottery stamp ticket book of three tickets, the tabs on the top two tickets are opened, the top ticket is folded back along a crease.

As shown in FIG. 9, a second means of conferring flexibility upon the tickets 10 is by providing a crease 28 between the binding region 16 and the tab 22. Providing such a crease 28 would allow the tickets 10 to naturally fold along the crease 28 so that each ticket may be bent away from adjacent tickets 10 in the bonded lottery stamp ticket book 8. The top ticket 10 in FIG. 9 is bent back along the crease 28, the second ticket 10 is not folded back, showing the crease 28 prior to folding.

The bonded lottery stamp ticket book 8 described herein allows a person to play a unique lottery game wherein a bonded lottery stamp ticket book 8, substantially as described, is provided and the person playing the lottery game would displace the tabs 22 to reveal the indicia 14. A player may "win" by holding a bonded lottery stamp ticket book 8 containing indicia 14 that provide a predetermined pattern. Bonded lottery stamp ticket books 8 can be printed with only a defined percentage of the bonded lottery stamp ticket books 8 providing the predetermined pattern. Alternatively, a player of the lottery game would be required to match one of the indicia 14 of the bonded lottery stamp ticket book 8 with an externally provided indicia.

Having thus defined my invention in the detail and particularity required by the Patent Laws, what is desired to be protected by Letters Patent is set forth in the following claims.

I claim:

1. A bonded lottery stamp ticket book, comprising:

a plurality of stiff tickets secured to each other, each ticket comprising:

(a) a first layer having an upper surface and a binding region, said upper surface having indicia, and (b) a second layer, said second layer comprising a border and a tab, said second layer having a lower surface, said lower surface being attached to said upper surface of said first layer at said border, said tab being frangibly attached to said border so as to cover said indicia, such that opening of said tab reveals said indicia, wherein each of said tickets has sufficient flexibility such that said tickets can be bent away from adjacent tickets in said book, wherein said tickets are stacked upon and bonded to each other at said binding region wherein each of said tabs includes a side that is permanently attached to said border, said tab is opened by bending said tab away from said ticket to reveal said indicia but said tab remains attached to said ticket and wherein said side that is permanently attached to said border is adjacent to said binding region such that said tab is opened and bent towards said binding region.

2. A method for manufacturing a bonded lottery stamp ticket book having a plurality of tickets, comprising:

(a) forming a ticket by attaching a second layer to a first layer having an upper surface and a binding region, said upper surface including indicia, said second layer comprising a border and a tab, said second layer having a lower surface, wherein said lower surface of said second layer is attached to said upper surface of said first layer by said border, said tab being frangibly attached to said border, said tab covering said indicia such that said tab can be displaced to reveal said indicia, wherein each of said tickets can be bent away from adjacent tickets in said book, (b) stacking said tickets atop one another, and (c) binding said tickets to one another, wherein each of said tabs includes a side that is permanently attached to said border, said tab is opened by bending said tab away from said ticket to reveal said indicia but said tab remains attached to said ticket, and wherein said side that is permanently attached to said border is adjacent to said binding region so that said tab is opened and bent towards said binding region.

3. The bonded lottery stamp ticket book of claim 1 wherein each of said tabs is frangibly attached to said ticket by perforations in said second layer.

4. The bonded lottery stamp ticket book of claim 3 wherein said perforations substantially form a U-shape.

5. The bonded lottery stamp ticket book of claim 1 wherein each of said tickets has a crease between said binding region and said tab, such that each of said tickets can be bent away from adjacent tickets in said book.

6. The bonded lottery stamp ticket book of claim 1 wherein each of said tickets is between 0.006 to 0.044 inch thick.

7. The bonded lottery stamp ticket book of claim 1 wherein each of said tickets has a length to thickness ratio greater than 50:1.

8. The method of manufacturing a bonded lottery stamp ticket book having a plurality of tickets as claimed in claim 2 wherein said tab is frangibly attached to said border by perforations in said second layer.

9. The method of manufacturing a bonded lottery stamp ticket book having a plurality of tickets as claimed in claim 8 wherein said perforations substantially form a U-shape.

* * * * *